US007338294B2

(12) United States Patent
Polnyi

(10) Patent No.: US 7,338,294 B2
(45) Date of Patent: Mar. 4, 2008

(54) PRESSURE CONTACT CONNECTOR

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/476,298

(22) Filed: Jun. 28, 2006

(65) Prior Publication Data

US 2008/0003844 A1 Jan. 3, 2008

(51) Int. Cl.
*H01R 12/00* (2006.01)

(52) U.S. Cl. ..... 439/66

(58) Field of Classification Search ..... 439/66, 439/71, 862

See application file for complete search history.

(56) References Cited

U.S. PATENT DOCUMENTS 4,505,529 A * 3/1985 Barkus ..... 439/82
4,927,369 A * 5/1990 Grabbe et al. ..... 439/66
4,998,886 A * 3/1991 Werner ..... 439/66
5,139,427 A * 8/1992 Boyd et al. ..... 439/66
5,230,632 A * 7/1993 Baumberger et al. ..... 439/66
5,498,166 A * 3/1996 Rothenberger ..... 439/66
5,759,048 A * 6/1998 Korsunsky et al. ..... 439/66
5,893,761 A * 4/1999 Longueville ..... 439/66
6,217,341 B1 * 4/2001 Glick et al. ..... 439/66
6,345,987 B1 * 2/2002 Mori et al. ..... 439/66
6,488,513 B1 * 12/2002 Neidich et al. ..... 439/66
6,666,690 B2 * 12/2003 Ishizuka et al. ..... 439/66
7,019,222 B2 * 3/2006 Vinther ..... 174/260

* cited by examiner

*Primary Examiner*—Tulsidas C. Patel
*Assistant Examiner*—Vladimir Imas
(74) *Attorney, Agent, or Firm*—We Te Chung

(57) ABSTRACT

A pressure connector according to one embodiment includes an insulative housing (10) with a plurality of spring contact elements (12) received in cavities (100) of the insulative housing. The contact elements have contact ends (122, 124) extending out of the cavities from opposite surfaces of the insulative housing. Each contact element is comprised of one piece wire-like member wrapped to form a helical-shaped loop configuration (126) to be held in one of the cavities, wherein the contact end is electrically connected to the other end by the helical-shaped loop configuration. Thus, with such spring contact, good contact spring with reduced contact inductance can be achieved.

2 Claims, 7 Drawing Sheets

PRESSURE CONTACT CONNECTOR

BACKGROUND OF THE INVENTION

1. Field of the Invention

The present invention relates generally to the art of electrical connectors, and particularly to pressure contact connectors, such as land grid array (LGA) sockets, which are operable to establish and maintain electrical connection between two contact interfaces.

2. General Background

The development of the electronic industry toward the miniaturized, high-density and more reliable trends has required many electrical connectors, to be arranged in a high-density manner to keep up with the trends. Ball Grid Array ("BGA") connectors have been widely used as the high-density interconnection between contact interfaces of separate electronic components, such as a chip and another printed circuit board, with solder balls on a surface of the connector to be heated to provide connection to at least one of the electronic components, such as the circuit board. The solder balls, however, often exhibit poor connection to the circuit board, in that they are not always suitable to overcome variations that may occur in the circuit board. Additionally, once the solder balls are soldered to provide the connections, the circuit board or chip can not be easily removed therefrom to correct any defect in the soldering formation, without reworking all of the solder balls and reflowing the ball grid array to the circuit board in another attempt to provide a more reliable connection.

Pressure connectors, such as land grid array (LGA) sockets, may offer numerous advantages over the BGA connectors regarding the above shortcomings to establish such a reliable connection between the electronic component, for example the chip, and the circuit board, by use of pressure contacts, such as formed spring contacts, that are embedded in the connector body with upper or lower contact section thereof in contact with pads formed on the surface of the chip or the board. In designing of the LGA sockets, conductive contacts have been often expected to be long enough and spring powerful enough to provide permanent and sufficient contact force requirements, especially when sizes of the conductive contacts are dramatically reduced to be held in cavities with minimized pitches arranged therebetween.

SUMMARY OF THE INVENTION

A pressure connector according to some embodiments includes an insulative housing having cavities therein. A plurality of spring contact elements is assembled to the insulative housing and located in the cavities. The contact elements have contact ends extending out of the cavities from opposite surfaces of the insulative housing. Each contact element is comprised of one piece wire-like member, such as member having a rounded cross-sectional shape, wrapped to form a helical-shaped loop configuration to be held in one of the cavities of the insulative housing, wherein the contact ends are electrically connected to the other ends by the helical-shaped loop configurations.

The provision of the spring contact has one of the advantages that good contact spring with reduced contact inductance is achieved due to having the loop configuration. Further, since each of the spring contact is made from one piece wire-like member, and often has a round cross-sectional shape, the electrical connector can be formed with much more cavities or holes with minimized pitches therebetween for receiving the spring contacts to provide a greater density of electrical connector.

Other features and advantages of the present invention will become more apparent to those skilled in the art upon examination of the following drawings and detailed description of preferred embodiments, in which:

DETAILED DESCRIPTION OF THE EMBODIMENTS

Figure 1:
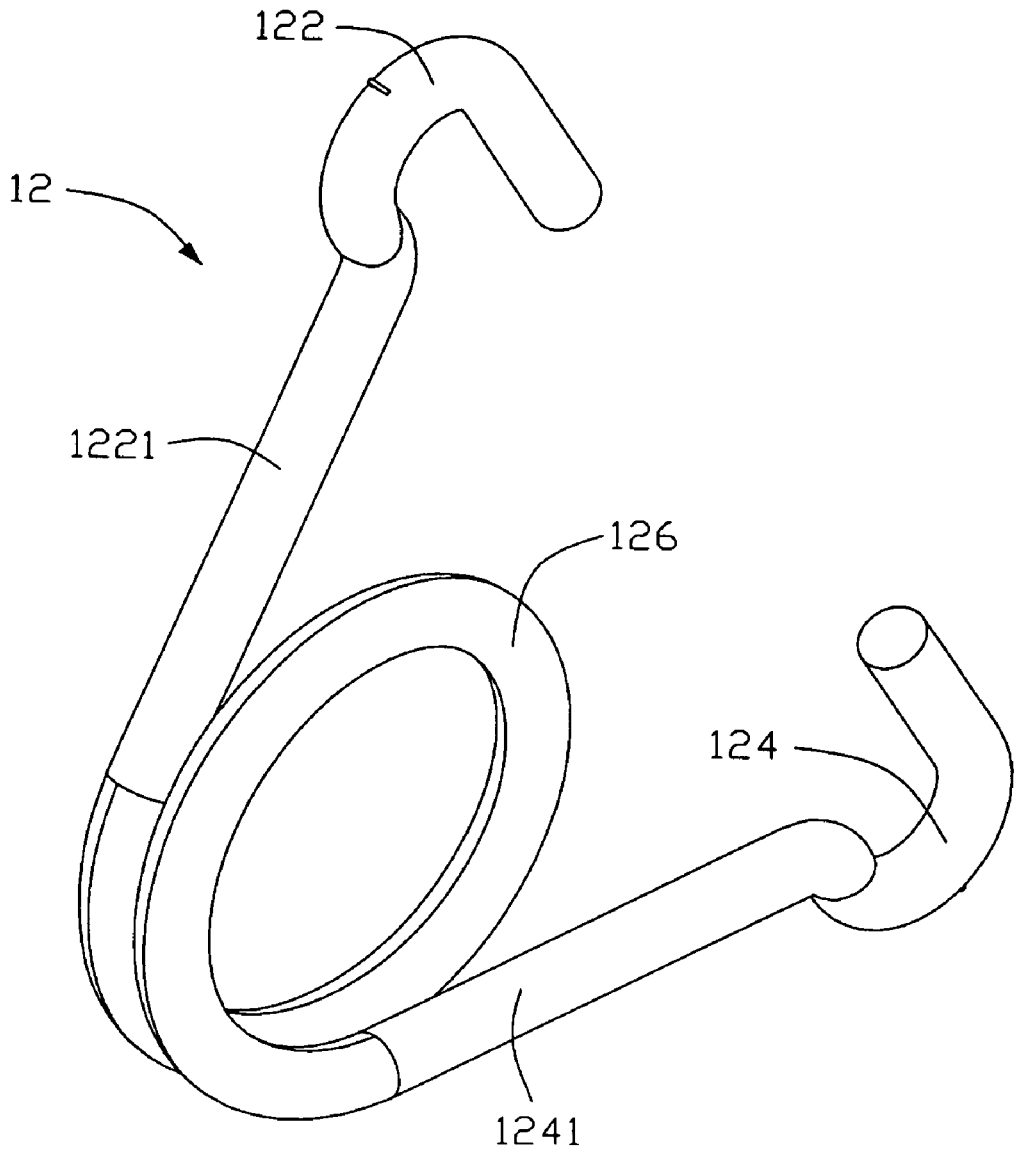
FIG. 1 is an isometric view of a spring contact used for an electrical connector according to a first embodiment of the present invention, showing the spring contact in free form.
Figure 2:
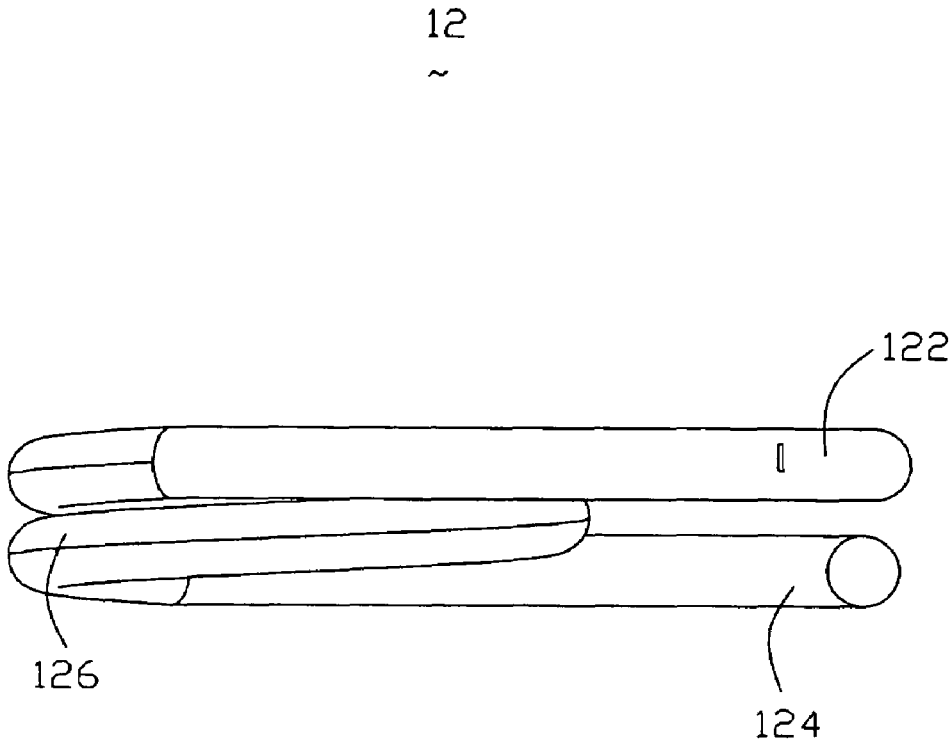
FIG. 2 is a top, plan view of the spring contact of FIG. 1.

The electrical connector according to embodiments of the present invention is used for establishing electrical connection between separate electronic components such as circuit boards, in which a multiply of electrical connections, such as, for example lands or pads, are formed on respective contact surfaces of the circuit boards.

Referring to FIGS. 1 to 4, the electrical connector according to the first embodiment is placed between two parallel-spaced circuit boards 2, 3, and includes an insulative housing or body 10 with therein cavities or holes 100, which are adapted for receiving and engaging spring contacts 12 to have ends 122, 124 of the spring contacts 12 extending out of opposite surfaces of the insulative housing 10. To simplify the illustration of the embodiment, the insulative housing is shown to have merely one cavity with a spring contact 12 received and engaged therein.

Each spring contact 12 is a one-piece wire-like member to be wrapped on itself to form a spring ring or helical-shaped loop configuration 126 around a middle or center section thereof with longitudinally spaced conductive contact ends 122, 124 for establishing electrical connections with the circuit boards. In one process of forming such a spring contact 12, a wire-like conductive member may be wrapped about a horizontally disposed rounded rod to have one or more continuous complete spring rings or loops around the middle section thereof, and two contact ends 122, 124 curved to provide contact surfaces for purposes of electrical connections. In this embodiment, the spring contact 12 is shown to have one complete spring ring. However, in other alternative embodiments, the spring contact 12 may have any suitable numbers of complete spring rings, such as for example, two, three, four, five, . . . etc., depending on where the spring contact is applicable. The complete spring rings of the spring contact 12 may be arranged in a continuous or uncontinuous manner. In some embodiments, however, such a spring ring configuration 126 may include a few incomplete spring rings, for example, portion or portions of one or more complete spring rings. The loop configuration 126 is preferably formed on the center section of the one-piece wire-like member, although it may be located adjacent the center section between an upper section and a lower section of the spring contact, such as for example, on a lower portion of the upper section or on an upper portion of the lower section. In this embodiment, the wire-like member of the spring contact 12 is entirely made of conductive material, such as metal material. However, in alternative embodiments, the wire-like member of the spring contact 12 may be comprised of combination of conductive material, such as for example, part of the wire-like member entirely made of conductive material, and outer portion of the remainder made of non-conductive material with interior portion of conductive material electrically connected to the part whereby the entire wire-like member is electrically conductive. It should be noted that, the wire-like member of the spring contact 12 might have any suitable cross-sectional shape, such as rounded or rectangular shape, depending on various applications.

The contact ends 122, 124 of the spring contact 12 are configured to engage with corresponding electrical contact points of the circuit boards, such as for example, lands formed on an LGA package and pads located on a printed circuit board. In this embodiment, the spring contact 12 includes a pair of identical contact ends 122, 124 with each having a U-shaped configuration for engagement with the circuit boards 2, 3. The contact ends 122, 124 have mouths facing towards each other, and are laterally offset, in a horizontal plane, by the spring rings, if any spring ring is included in the loop configuration 126. It should be noted that, in other alternative embodiments, the contact ends 122, 124 may have other suitable curved shapes for engagement with the circuit boards 2, 3.

A pair of spring arms, such as upper spring arm 1221 and lower spring arm 1241, is configured to extend upward and downward from free ends of the loop configuration 126 so as to electrically connect with the contact ends 122, 124 and the loop configuration 126. In this embodiment, the upper and lower spring arms 1221, 1241 are obliquely symmetrical with respect to the spring ring configuration 126. That is, the upper and lower spring arms 1221, 1241 extend from a point, where the spring ring closes a complete loop, such that the upper and lower spring arms 1221, 1241 in free state form same angles, designated as "$\alpha$", with respect to a common horizontal plane. In alternative embodiments, different angles are formed between the spring arms 1221, 1241 and the common horizontal plane. Further, in FIG. 2, the spring arms are laterally offset by the loop configuration in a horizontal plane.

Figure 4:
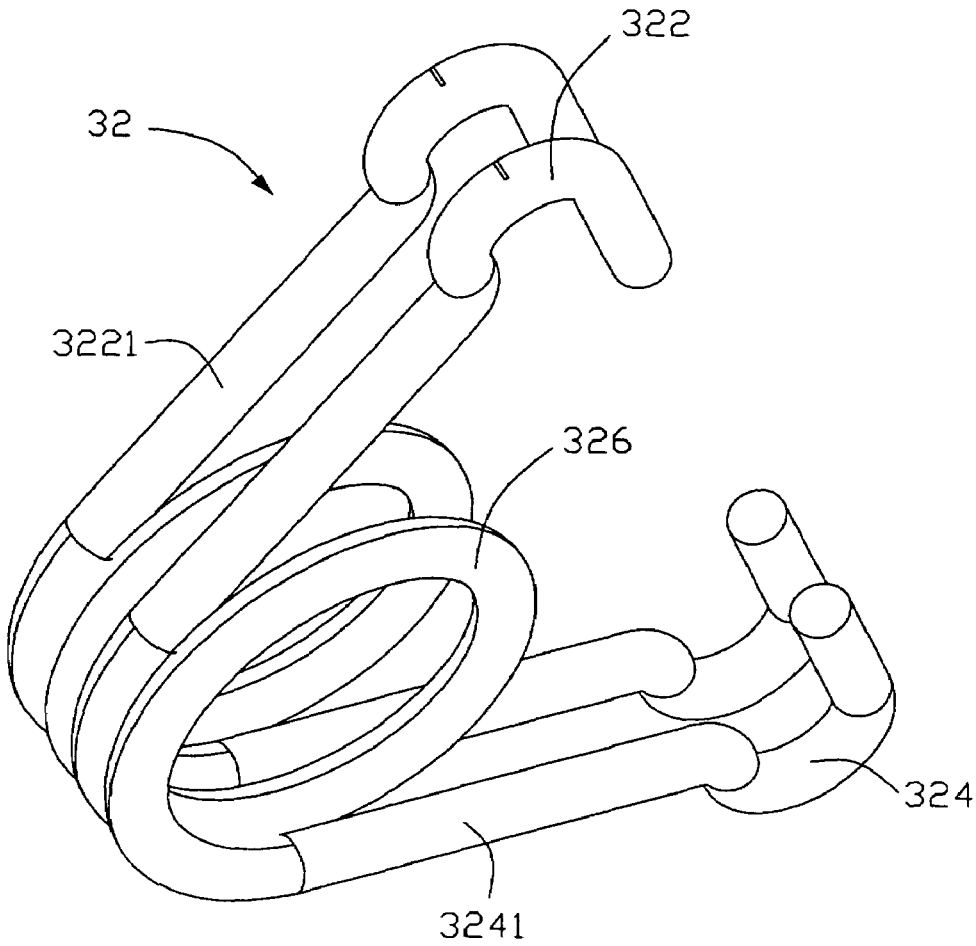
FIG. 4 is an isometric view of a set of separate spring contacts used for an electrical connector according to a second embodiment of the present invention, showing the spring contacts in free form.

Referring to FIG. 4, the insulative housing 10 of this embodiment includes a plurality of cavities 100 with each configured to engage one spring contact 12. Specifically, the cavity 100 is provided with a receiving space adapted to receive the spring ring configuration 126 of the spring contact 10. Such a receiving space is defined by combination of a semi-circle or curved side 101 of the insulative housing 10 and an insulative crossbar 103 formed adjacent opposite side of the insulative housing. The insulative crossbar 103 is generally of a T-shaped configuration, and arranged to prevent the opposite contact ends 122, 124 of the spring ring from being in a direct contact with each other to form a closed circuit.

Figure 3:
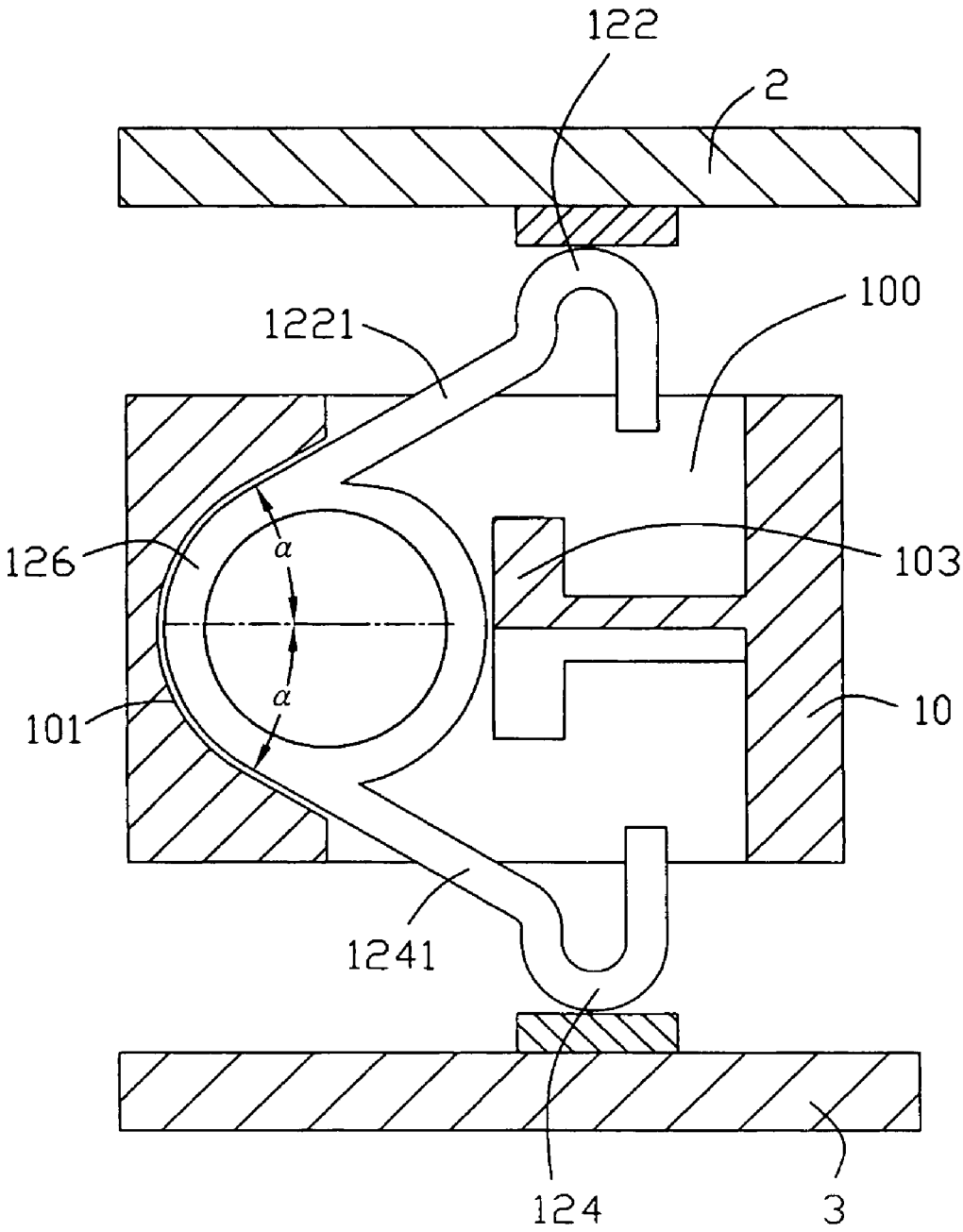
FIG. 3 is a cross-sectional view of part of an electrical connector sandwiched between two separate circuit boards, with one spring contact of FIG. 1 held in an insulative housing of the electrical connector.

Referring to FIG. 3, in use, it is presumed that the electrical connector is pre-sandwiched between the LGA package 2 and the printed circuit board 3. When the spring contact 12 is compressed, deflection of the contact ends 122, 124 causes the spring ring or rings to be radially and elastically expanded in diameter so as to frictionally hold the contact element 12 in the cavity 100 of the insulative housing 10. Thus, the expanded spring ring or rings of the loop configuration 126 is frictionally held in the receiving space of the insulative housing 10. Further, in some instances, if the upper contact end 122 is compressed to a lower position, the insulative crossbar 103 may be employed to prevent one contact end 122 from being in a direct and electrical contact with the other end 124. Therefore, an electrical path is formed, in sequence through the upper contact end 122, the spring ring configuration 126 and the lower contact end 124, between the circuit boards 2, 3 placed on the electrical connector.

The provision of the spring contact 12 has the advantage that good contact spring with reduced contact inductance is achieved due to having the loop configuration 126. Further, since each of the spring contacts 12 is made from one piece wire-like member, and often has a round cross-sectional shape, the electrical connector can be formed with much more cavities or holes 100 with minimized pitches therebetween for receiving the spring contacts 12 to provide a greater density of electrical connector.

Figure 5:
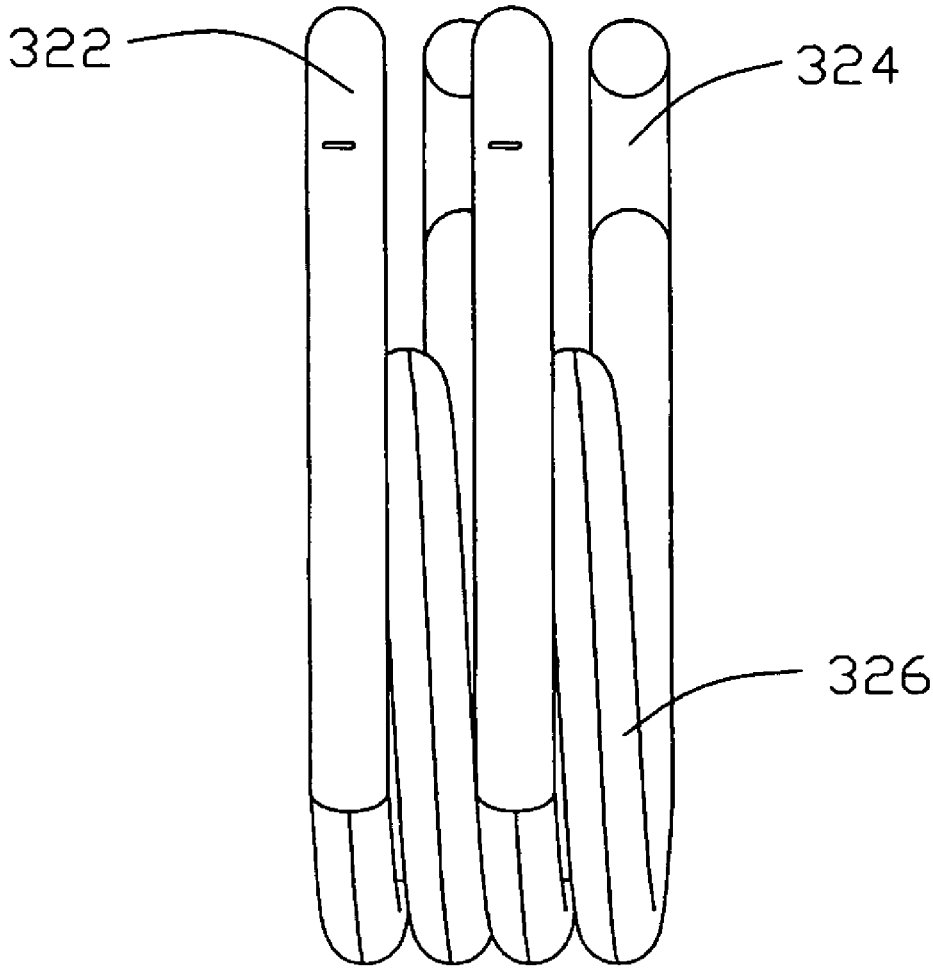
FIG. 5 is a top, plan view of the spring contacts of FIG. 4.
Figure 6:
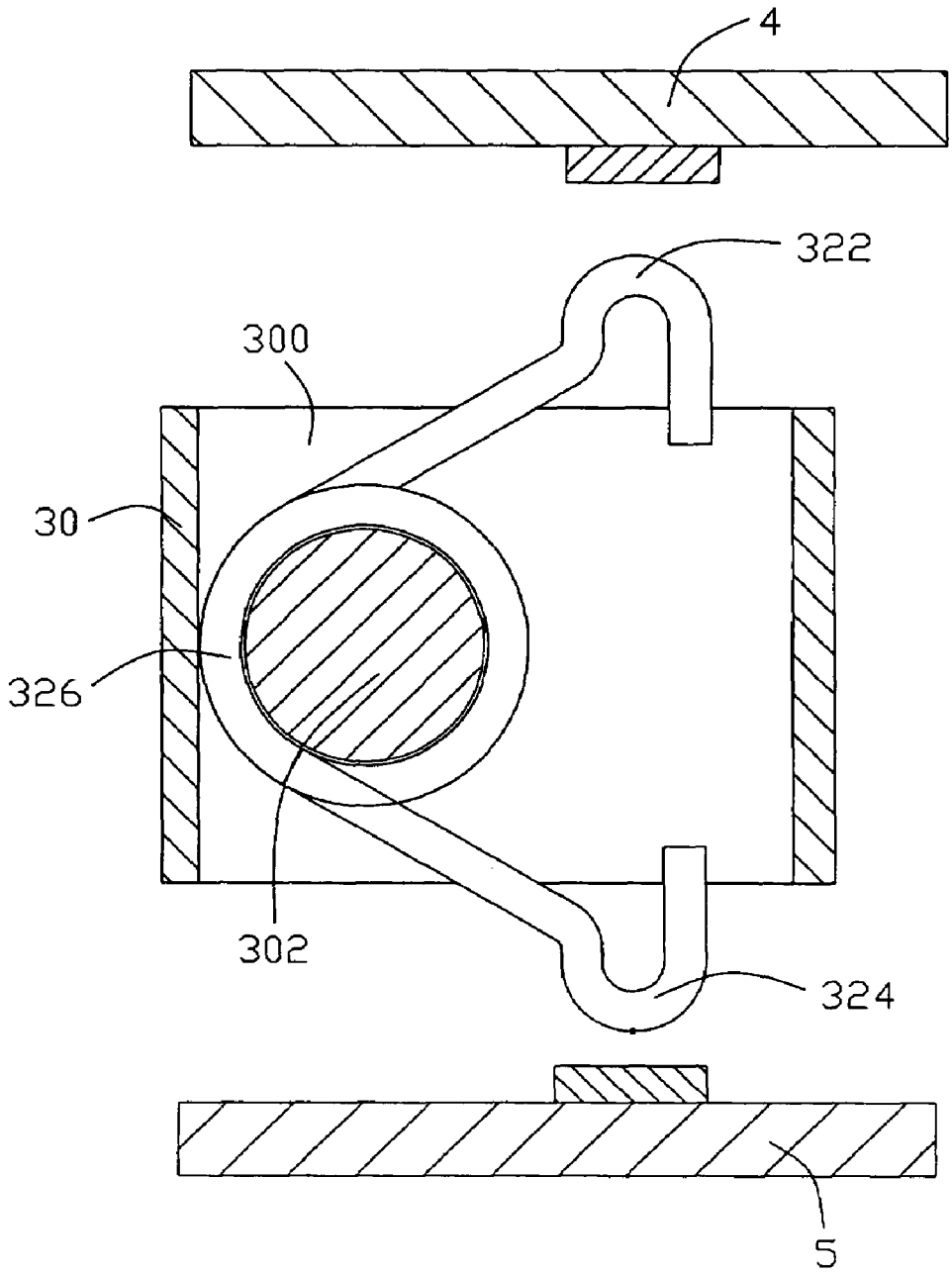
FIG. 6 is a simplified, cross-sectional view of part of an electrical connector, with the set of spring contacts of FIG. 6 held in a hole of the electrical connector.
Figure 7:
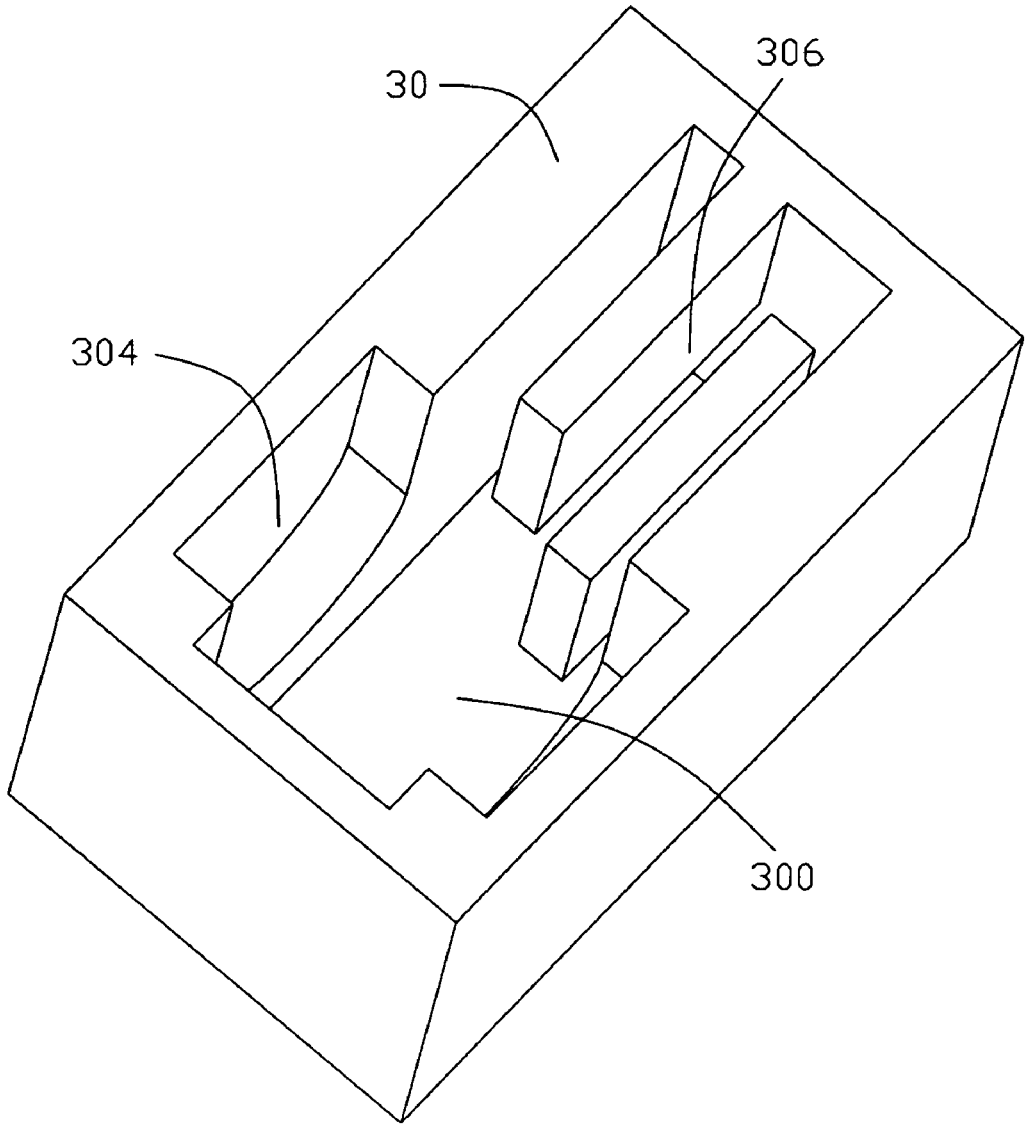
FIG. 7 is an isometric view of part of the socket body of the electrical connector, showing interior structure of the hole of the connector body.

Referring to FIGS. 5 to 7, an electrical connector according to the second embodiment of the present invention is shown for electrical connection with two circuit boards, such as for example, the LGA package 4 and the printed circuit board 5. The electrical connector includes an insulative housing or body 30 with cavities or holes 300 adapted to receive and engage spring contacts 32 to have opposite ends 322, 324 of the spring contacts 32 extending from opposite surfaces of the insulative housing 30. To simply the illustration of this embodiment, the insulative housing 30 is shown to have part of one cavity 300 with a set of spring contacts 32 received and engaged therein. In this embodiment, two separate spring contacts 32 are held within the cavity 300 with no attachment provided therebetween. Since two spring contacts 32 are received in one cavity 300 of the insulative housing 30, two contact points are provided at each contact side of the spring contacts 32 for engaging with a corresponding electrical connection of the circuit board, such as for example, an land of the LGA package 4. However, in alternative embodiments, some suitable attachment means may be provided for attaching the spring contacts 32 together at any predetermined position of the set of spring contact, such as for example, at a portion of a spring ring configuration 326. It should be noted that, each cavity 300 of the insulative housing 30 could be configured to receive any suitable number of spring contacts 32 according to different embodiments. Accordingly, if there is a predetermined number of spring contacts 32 held in one cavity, the predetermined number of contact points is formed at each contact side of the spring contacts 32 for purpose of engagement with a corresponding electrical connection of the circuit board.

In this embodiment, the set of spring contacts 32 is supportably held in the cavity 300 by a rounded rod 302 therein extending through the loop configurations 326 of the spring contacts 32. FIG. 7 depicts two separate spring contacts 32 being held in the cavity 300 of the insulative housing 30, but merely showing part of the cavity 300 therein. Referring to FIG. 8, in some embodiments, each cavity 300 of the insulative housing 30 defines lengthwise sides and lateral sides thereof, with separating blocks 306 located at one of lateral sides, and a pair of grooves 304 respectively formed at portions of lengthwise sides of the insulative housing 30 away from the separating blocks 306 end. The separating blocks 306 are arranged in a staggered manner for separating the upper contact ends 322 and the lower contact ends 324 so as to prevent electrical connection between the upper ends 322 and the lower ends 324. The grooves 304 are provided for the rounded rod 302 to be supported therein. It should be noted that, cavities 300 for engaging the spring contacts 32 might have other suitable configuration except for the cavity shown in FIG. 8.

Referring still to FIG. 7, in use, it is presumed that the electrical connector is pre-sandwiched between the LGA package 4 and the printed circuit board 5. When the spring contact 32 is compressed, deflection of the contact ends 322, 324 causes the spring ring or rings to be slidably moveable with respect to an axial direction of the rounded rod 302 to have the spring rings abutting against the opposite sidewalls of the insulative housing 300 while still engaging with each other to establish mechanical and electrical connection between the spring contacts 32. Thus, the spring contacts 32 are held in the receiving space of the insulative housing 300. Further, in some instances, if the upper contact ends 322 are compressed to a lower position, the insulative blocks 306 are employed to prevent one contact end 322 from being in a direct and electrical contact with the other end 324. Therefore, one directional electrical path is formed, in sequence through the upper contact ends 322, the spring ring configuration 326 and the lower contact ends 324, between the circuit boards 4, 5 placed on the electrical connector.

The provision of the spring contacts 32 within one cavity 300 of the insulative housing 30 has the advantage that two or more contact points are formed at each contact side of the spring contacts 32 for engagement with a corresponding electrical connection of the circuit board, as well as the advantage of having good contact spring with reduced contact inductance due to the loop configurations 326. Further, since each of the spring contacts 32 is made from one piece wire-like member, and often has a round cross-sectional shape, the electrical connector can be formed with much more cavities or holes 300 with minimized pitches therebetween for receiving the spring contacts 32 to provide a greater density of electrical connector.

While the present invention has been described with reference to embodiments, the description of the invention is illustrative and is not to be construed as limiting the invention. Various of modifications to the present invention can be made to embodiments by those skilled in the art without departing from the true spirit and scope of the invention as defined by the appended claims.

What is claimed is:

1. An electrical connector comprising:

an insulative housing defining a plurality of passageways extending therethrough in a vertical direction;

a plurality of conductive contacts disposed in the corresponding passageways, respectively;

each of said contacts bent from one round wire and defining at least one loop section with two opposite end sections extending beyond two opposite faces of said housing in said vertical direction; wherein each of said passageways receives a pair of juxtaposed contacts under a condition that said pair of juxtaposed contacts intimately mechanically and electrically engaged with each other while depressed independently.

2. The electrical connector as claimed in claim 1, wherein each passageway having a first wall defining a concave space therein in compliance with the loop section.

* * * * *